US009742058B1

(12) United States Patent
O'Neill, Jr. et al.

(10) Patent No.: US 9,742,058 B1
(45) Date of Patent: Aug. 22, 2017

(54) DEPLOYABLE QUADRIFILAR HELICAL ANTENNA

(71) Applicant: Gregory A. O'Neill, Jr., Rockledge, FL (US)

(72) Inventors: Gregory A. O'Neill, Jr., Rockledge, FL (US); David M. Cross, Rockledge, FL (US)

(73) Assignee: Gregory A. O'Neill, Jr., Rockledge, FL (US)

( * ) Notice: Subject to any disclaimer, the term of this patent is extended or adjusted under 35 U.S.C. 154(b) by 0 days.

(21) Appl. No.: 15/223,672

(22) Filed: Jul. 29, 2016

Related U.S. Application Data

(60) Provisional application No. 62/202,021, filed on Aug. 6, 2015.

(51) Int. Cl.
*H01Q 1/28* (2006.01)
*H01Q 1/36* (2006.01)
*H01Q 1/08* (2006.01)

(52) U.S. Cl.
CPC ..... *H01Q 1/288* (2013.01); *H01Q 1/08* (2013.01); *H01Q 1/362* (2013.01)

(58) Field of Classification Search
CPC ..... H01Q 1/288; H01Q 1/08; H01Q 1/362
(Continued)

(56) References Cited

U.S. PATENT DOCUMENTS 3,699,585 A * 10/1972 Morrison ..... H01Q 11/086 343/880
3,836,979 A * 9/1974 Kurland ..... H01Q 11/086 343/881

(Continued)

OTHER PUBLICATIONS

Muri et al.; Enhancing Small Satellite Communication Through Effective Antenna System Design; Military Communication Conference; Nov. 3, 2010.*

(Continued)

*Primary Examiner* — Dameon E Levi
*Assistant Examiner* — Ab Salam Alkassim, Jr.
(74) *Attorney, Agent, or Firm* — Brian S. Steinberger; Law Offices of Brian S. Steinberger, P.A.

(57) ABSTRACT

Systems, devices, and methods for providing deployable and collapsible Quadrifilar Helical Antennas (QHA) on small satellites to improve communications in low earth orbit satellites. Monopole antennas are very popular for use on small satellites, generally because they are relatively easy to attach. By using circularly polarized antennas for the spacecraft and the ground station, polarization losses are virtually eliminated. The QHA can be designed to have a wide range of circularly polarized antenna patterns. Low power transmitters are employed on the small satellite to be consistent with the available energy. The communication link budgets are dependent on good radiation pattern characteristics for the small satellite downlink where higher data rates are required. Quadrifilar Helical Antennas can be collapsed and stowed inside a module to mount inside typical cubes known as 1U through 27U size small satellites. After launch from the rocket, the QHA can be deployed to its stored memory shape. The QHA radiating filars can be made from Nitinol wires having an activation temperature above which the filars resume their stored memory shape acquired during heating treatments. QHA applies an electrical direct current onto the filars after launch of the small satellite independent of the radio frequency of the QHA.

18 Claims, 15 Drawing Sheets

(58) Field of Classification Search
USPC ..... 343/705
See application file for complete search history.

(56) References Cited

U.S. PATENT DOCUMENTS 3,913,109 A * 10/1975 Owen ..... H01Q 1/084 343/880
4,068,238 A * 1/1978 Acker ..... H01Q 1/084 343/895
4,087,820 A * 5/1978 Henderson ..... H01Q 1/084 343/752
4,475,111 A * 10/1984 Gittinger ..... H01Q 11/086 343/881
4,725,025 A * 2/1988 Binge ..... B64G 9/00 136/245
4,780,727 A * 10/1988 Seal ..... H01Q 11/086 343/880
5,129,753 A * 7/1992 Wesley ..... B64G 1/222 403/322.3
5,154,027 A * 10/1992 Warden ..... E04H 12/185 343/880
5,594,461 A 1/1997 O'Neill
5,668,565 A * 9/1997 Robinson ..... H01Q 1/085 333/34
5,721,558 A * 2/1998 Holemans ..... H01Q 11/086 343/880
5,793,338 A 8/1998 Standke
5,896,113 A 4/1999 O'Neill
5,909,196 A 6/1999 O'Neill
5,909,197 A * 6/1999 Heinemann ..... H01Q 1/1235 343/880
5,920,292 A 7/1999 O'Neill
5,977,932 A * 11/1999 Robinson ..... B64G 1/22 16/226
5,986,619 A * 11/1999 Grybos ..... H01Q 1/288 343/853
6,450,725 B1 * 9/2002 Roth ..... B64G 1/222 294/86.4
6,480,173 B1 11/2002 Marino
6,549,788 B1 4/2003 Karabinis
6,972,659 B2 * 12/2005 von Behrens ..... E05B 47/0009 337/139
7,098,855 B2 8/2006 Kotzin
7,173,576 B2 2/2007 O'Neill
7,245,268 B2 7/2007 O'Neill
7,489,281 B2 2/2009 O'Neill
7,663,555 B2 2/2010 Caimi
7,753,632 B2 * 7/2010 Naitou ..... F16B 1/0014 411/390
7,834,813 B2 11/2010 Caimi
7,978,148 B2 7/2011 O'Neill
8,000,737 B2 8/2011 Caimi
8,970,447 B2 3/2015 Ochoa
9,203,362 B2 12/2015 Wright
9,470,213 B2 * 10/2016 Koehler ..... F03G 7/065
2011/0298688 A1 * 12/2011 Jalali Mazlouman ... H01Q 9/14 343/895
2012/0146880 A1 * 6/2012 Behrens ..... B64G 1/222 343/895
2013/0069833 A1 3/2013 Lippincott
2013/0292526 A1 * 11/2013 Murphy ..... H01Q 1/08 248/157
2014/0232611 A1 * 8/2014 Ochoa ..... H01Q 1/288 343/881
2015/0102172 A1 4/2015 Thurn
2015/0372374 A1 * 12/2015 Judd ..... H01Q 1/08 244/172.6
2016/0047363 A1 * 2/2016 Alacqua ..... F03G 7/065 251/213

OTHER PUBLICATIONS

Villasenor; Hellical Antennas Using Shape Memory Metal; University of Colorado Boulder; Apr. 16, 2010.*
Huang; Shape Memory Alloys and their Application to Actuators for Deployable Structures; University of Cambridge Department of Engineering; Mar. 1998.*
Dye, N., et al., Radio Frequency Transistors; Principles and Practical Applications, Newnes, Butterworth-Heinemann, 2001, pp. 206-208, 6 pages.
Vizmuller, P., RF Design Guide; Systems, Circuits, and Equations, Artech House, 1995, pp. 69-71, 6 pages.
Adam Thurn, et al., A Nichrome Burn Wire Release Mechanism for CubeSats, Proceedings of 41st Aerospace Mechanisms Symposium, Jet Propulsion Laboratory, May 16-18, 2012, pp. 1-10.
P. Rossoni, Structural Bus and Release Mechanisms on the ST5 Satellites—Summary and Status, in Aerospace Conference, 2007 IEEE, Mar. 2007, 14 pages.

* cited by examiner

DEPLOYABLE QUADRIFILAR HELICAL ANTENNA

CROSS REFERENCE TO RELATED APPLICATIONS

This application claims the benefit of priority to U.S. Provisional Application Ser. No. 62/202,021 filed Aug. 6, 2015, the entire disclosure of which is incorporated herein by specific reference thereto.

FIELD OF INVENTION

This invention relates to satellite antennas, and in particular to systems, devices, and methods for providing deployable and collapsible Quadrifilar Helical Antennas (QHA) on small satellites to improve communications in low earth orbit satellites.

BACKGROUND AND PRIOR ART

Antennas for many small satellites have been pretty simple monopoles set to spring out during the launch release. The antenna radiation from a monopole antenna using the satellite body as the counterpoise is primarily a linear polarization pattern in the general form of a toroid. A monopole antenna in this sense is considered to be a quarter wave whip while using the small satellite as the counterpoise. In order to receive the maximum signal from this linear monopole antenna pattern, a similarly polarized antenna at the ground station is desirable. Then the ground station antenna should be able to be rotated about the axis between the satellite and the ground station in order to keep receiving the maximum available signal level. The polarization changes for a linearly polarized antenna as it traverses its orbit. Thus, the relative polarization as received at the ground station antenna changes. The ground station antenna should be able to track this polarization rotation as well as to be able to track the movement of the small satellite.

Another aspect of the simple monopole antennas is that the linear antenna gain pattern can be maximum below the nadir. At slant angles approaching 60 degrees, the antenna gain is reduced more than 10 dB.

The small satellite named A0-73, FIG. 4, is representative of similar small satellites that use simple monopoles or dipoles for the communication antennas. The problem with these antennas is that their radiation pattern resembles the pattern shown in FIG. 6. The problem with these kinds of antennas is that they have a relatively narrow beamwidth. The narrow beamwidth reduces the time the satellite will have sufficient communication link margin. The reduced time for communication then limits the amount of data or communications to a ground station.

FIG. 4 shows a perspective view of prior art AO-73 Fun Cube Antennas. The AO-73 Fun Cube satellite is an example of simple antennas on a quite small satellite. While adequate for short communication, the antennas provide limited capability for communication. The subject invention, quadrifilar helical antenna can increase the coverage area and the amount of communication per orbit over a ground station.

FIG. 5 shows a prior art view of a 436.5 MHZ Horizontal Monopole on the right, and a 145 MHz Monopole on left side of a 1U small satellite with a wide beam along the X orbit direction and narrow beam on both sides of the X path, another example of prior art. The problem with these antennas is that the narrow beam widths reduce the time the satellite will have sufficient communication link margin. The reduced time for communication then limits the amount of data or communications to a ground station.

FIG. 6 is a perspective view of a prior art antenna pattern from the 436.5 MHz monopole from FIG. 5. For a satellite traveling in the +Y direction, there is a wide beam area along the X axis, but it is narrow in the Y direction. For a satellite traveling in +X direction, there is a narrow beam along the X axis, but narrow on either side of the X path. These narrow beam widths reduce the useable time and data available from the satellite as compared to an Iso-Flux Quadrifilar Helical Antenna in a deployed position.

The orbit of Small satellites is not well established soon after launch. It is difficult to find the small satellite when confined to utilizing azimuth, elevation rotatable Yagi's to locate the small satellite.

There are increasing numbers of small satellites also known as cube sats to be launched into mostly Low Earth Orbit from a dispenser being added to rockets that launch objects into space. These dispensers are becoming uniform amongst several rockets. As such, communication antennas are ideally stowed within the size restrictions of the dispenser.

The size of the small satellites is becoming known for the standard sizes as 1U through about 27U. A 1U cube satellite is approximately 100 mm×100 mm×100 mm. The realizable radiation patterns are less than optimal for the simple monopole antennas. Typical radiation patterns of 2 meter, 70 centimeters, and 12.5 centimeter antennas mounted on small satellites will be shown to provide illustrations of the diminished coverage area compared to a Quadrifilar Helical Antenna.

Other practitioners, even going back to Charles Kilgus, the original inventor of the quadrature filar antenna, focused their attention on the number of turns or partial turns of the structure; seemingly focused on incremental numbers of quarter wavelengths. Those antennas were mostly set to achieve a hemispheric antenna pattern.

U.S. Pat. No. 8,970,447 to Ochoa et al. describes a deployable helical antenna for nano-satellites. The Ochoa patent deployment means depends on use of a fuse-type element that when heated, breaks and allows the cover to flip open under a spring force. This means small pieces might break away into space which is undesirable. The helical antenna elements are wound outside of vertical stiffeners where upon release the elements are supposed to retain their desired shape. The patent loosely discusses folding and rolling the antenna into a stowed position with only a set of stiffeners that are supposed to resume a shape upon deployment. The stiffeners are suggested to be made from thermoplastic impregnated fiberglass. These stiffeners and their means to be attached to the helical metalized windings do not address the stresses after being stowed for long periods of time.

Further, the Ochoa patent is for dual wound helical antennas, not quadrifilar helical antennas. The Ochoa patent does not discuss any means to impedance match the antenna to a transmission line. The Ochoa patent does not discuss application to a quadrifilar helical antenna and therefore serves a different radiation pattern. The Ochoa patent does not discuss the possibility of shaping the antenna to develop an Iso-Flux antenna pattern.

Thus, there exists the need for solutions to the problems with the prior art.

SUMMARY OF THE INVENTION

A primary objective of the present invention is to provide systems, devices, and methods for providing deployable and collapsible Quadrifilar Helical Antennas (QHA) on small satellites to improve communications in low earth orbit satellites.

A secondary objective of the present invention is to provide systems, devices, and methods for providing deployable Quadrifilar Helical Antennas (QHA) with Nitinol wire processed so that it resumes its' stored memory shape when heated to its' activation temperature of approximately 80 degrees Centigrade.

A third objective of the present invention is to provide systems, devices, and methods for providing Iso-Flux antenna patterns. The Iso-Flux antenna pattern provides maximum gain at the long slant range from the Low Earth Orbiting satellite to a ground station and thereby providing nearly equal electromagnetic flux from Acquisition of Signal (AoS) to Loss of Signal (LoS) as the satellite transverses its Low Earth Orbit.

A fourth objective of the present invention is to provide systems, devices, and methods to transform the signal received or transmitted by the quadrifilar helical antenna from the four quadrature phased filars to a combined signal port. This transformation performs impedance transformation, development of the phase quadrature relation ship between filars and transforms a single coaxial feed to the phase balanced structure for the filars.

A fifth objective of the present invention is to provide systems, devices, and methods to be able to adjust the antenna diameter and filar pitch angle to achieve suitable dimensions for the other dimensional aspects for the antenna. An example is that for some antennas, the diameter can be too large for the allowable stowed volume. The present invention can use smaller diameters allowing the antenna to work in a smaller overall volume. This characteristic is allowed by application of impedance transforming coils and capacitors.

A sixth objective of the present invention is to provide systems, devices, and methods to be able to use the stored memory shape property of the Nitinol wire to form antennas other than quadrifilar helical antennas. The method shown herein can apply to any antenna where a series return can allow a direct current flow to heat the wire during deployment. An example of this would be any form of folded dipole or a spiral antenna with a center feed return wire.

A seventh objective of the present invention is to provide systems, devices, and methods to be able to use variants of the Nitinol wire and to indicate the satisfactory performance of the Nitinol wire. There was a concern as to the suitability of the Nitinol wire because of the conductivity of the Nitinol wire. Models of the present invention were constructed using copper wire, copper plated wire, copper diffused into Nitinol wire. The measured antenna patterns were compared and found to have very little difference in the antenna gain, thereby confirming the suitability of the Nitinol wire.

An eighth objective of the present invention is to provide an alternate system, devices, and methods to be able to transform the antenna impedance to the practical useful impedance of a single coaxial feed. In some circumstances, where the antenna needs to handle more power than subcircuits can handle, the quadrature lumped electrical network (QLEN) can be utilized.

Another reason to use the QLEN can be for frequency ranges where commercial quadrature couplers are not available, then QLEN's can be applied. The QLEN can be made from known lumped element baluns and known hybrid networks. The new method for the present invention is that these networks are combined as in the present invention with interfacing equal phase length transmission lines that results in a practical means to accomplish a quadrature combiner/splitter that can handle substantial levels of power and at frequencies where other methods are not available.

There are increasing numbers of small satellites also known as cube sats to be launched into mostly Low Earth Orbit from a dispenser being added to rockets that launch objects into space. These dispensers are becoming uniform amongst several rockets. As such, communication antennas are ideally stowed within the size restrictions of the dispenser. The size of the small satellites is becoming known for the standard sizes as 1U through about 27U. A 1U cube satellite is approximately 100 mm×100 mm×100 mm.

The Quadrifilar Helical Antenna (QHA) overcomes many of the difficulties of the linear monopole antenna. The circularly polarized solid beam angle of a small QHA can be designed to be from about 40 degrees solid angle to about 70 degrees. For smaller satellites, it can be necessary to use a shorter length QHA. For larger satellites, longer axial height antennas can be utilized.

It will be necessary to be able to continually align the QHA with the nadir. This alignment is an increasingly normal capability of small satellites. A definition of "nadir" is the point of the celestial sphere that is directly opposite the zenith and vertically downward from the observer.

It is desirable to develop deployment techniques for antennas designed to be used in small cube satellites meant to be launched from dispensers on the launching rocket.

This invention utilizes Nitinol wire processed so that it resumes its stored memory shape when heated to its activation temperature of 80 degrees Centigrade. Embodied in this invention is a technique to combine heating of the Nitinol filars in a manner that does not impede the radio frequency characteristics needed to match the received signal to the receiver.

A Quadrifilar Helical Antenna presents a better radiation pattern than a simple monopole antenna. Typical radiation patterns of 2 meter, 70 centimeters, and 2.4 GHz antennas mounted on small satellites provide diminished coverage area compared to a Quadrifilar Helical Antenna.

The present invention is different from the prior art because of its deployable characteristic. This difference includes the ability to deploy the antenna through the application of direct current into the bifilar loops without disturbing the radio frequency characteristics of the antenna.

Another aspect of the present invention is the finding a method to achieve the Iso-Flux antenna radiation pattern. This pattern is not easily described by conventional descriptions for Quadrifilar Helical Antennas in that the structure is not an even number of quarter wavelengths long. The presently described invention has been optimized for the desired frequency band by adjusting the structure to have the optimum Iso-Flux pattern.

The antenna Iso-Flux radiation pattern can be achieved by adjusting several of the dimensions of the bifilar loops in the following ways:

- The filar length can be adjusted to an approximate Iso-Flux antenna radiation pattern.
- The diameter of the structure can be required to be within a certain acceptable range for the small satellite.
- The pitch angle can become an important aspect of the desired Iso-Flux pattern, especially when considering the potential size limits that the antenna will need to be confined within.

The methods that have been used to determine the optimal dimensions involve the use of three dimensional electromagnetic antenna modeling software. The setup of the antenna structure files has been of considerable importance to guiding the structure to its optimal shape within the given constraints of the small satellite.

Other practitioners, even going back to Charles Kilgus, the original inventor of the quadrature filar antenna, focused their attention on the number of turns or partial turns of the structure; seemingly focused on incremental numbers of quarter wavelengths. Those antennas were mostly set to achieve a hemispheric antenna pattern.

The present invention focusing on the Iso-Flux antenna pattern, as well as several other QHA implementations, are not so focused on the increments of quarter wavelengths, but rather while generally using some incremental quarter wavelength strategy have allowed the structure to find an optimal filar length consistent with the desired objective, such as an Iso-Flux antenna pattern. The optimal structure for an Iso-Flux pattern can be found by repeated solutions of the antenna simulation until the optimal Iso-Flux antenna pattern is achieved within the structural constraints of the small satellite or other structure the antenna can be used for.

The means to arrange for:

driving point impedance matching at the proximal, the quadrature coupling, comprised of discrete inductors and capacitors. These inductors and capacitors for 90 degree hybrids tuned to the operating frequency band.

the balun to combine the quadrature components and change them from a balanced source or load to a single ended source or load.

All of the above circuits are combined on a printed circuit board with a transmission line of equal electrical lengths between balun and 90 degree hybrid elements.

The importance of this discrete configuration of a quadrature network has to do with the ability to choose components that are capable of handling significant Radio Frequency Power. Commercially available quadrature combiners generally can not handle the power desired. Typical power capability for this network is about 100 Watts. It could be designed to handle more power.

The means to secure the filars at the proximal are new in that a rotary joint is embedded so that the filars are allowed to rotate during deployment while they are captivated within the space such that they are not allowed to disengage.

The antenna structure can use Nitinol wire. The conductance of this wire is satisfactory for this type of antenna. The property that is unique is taking advantage of the shaped memory property of the metal when heated to an appropriate temperature and then cooled to be able to retain the shaped memory property. The shaped memory property is necessary to achieve the Iso-Flux antenna radiation properties. A specially designed stainless steel mandrel is a necessary component to achieving the satisfactory shaped memory property for the antenna. This antenna is carefully stowed through the use of a tool made from plastic that guides the filars toward the stowed position.

The cylindrical housings can be used to guide the filars from their stowed position to the deployed position incorporate a helical groove specially designed to guide the filars toward their deployed position. This feature becomes helpful in raising the natural frequency of oscillation for the structure on the small satellite.

The significance of this antenna has to do with the ability to deploy from the dispenser on an ascending rocket. This antenna has managed to be able to apply direct current to the Nitinol wire, allowing the wire to rise to the activating temperature without affecting the Radio Frequency performance of the antenna. The application calls for deployment of two bifilar loops of these antennas. A direct current circuit has been arranged so that each antenna element is wired in a series circuit configuration. Therefore, a simple command from the satellite can apply the direct current to the two bifilar loops of the antenna. The diameter of the wire has been scaled to have sufficient flexibility to allowing stowing while maintaining sufficient stability when deployed.

In a preferred embodiment a set of four retainer loops made from Nitinol wire and placed in Direct Current series with the bifilar loops has been found to help retain the antenna filars until the Direct Current is applied.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. In the Summary above and in the Detailed Description of Preferred Embodiments and in the accompanying drawings, reference is made to particular features (including method steps) of the invention.

It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention can, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Figure 1:
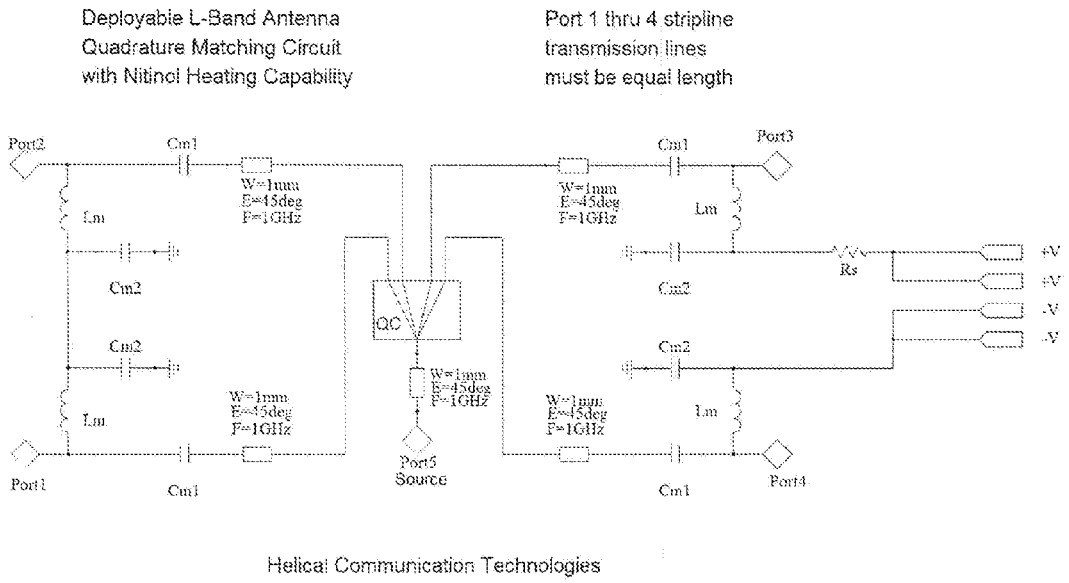
FIG. 1 shows a deployable L-Band antenna Quadrature matching circuit with Nintinol heating capability.

FIG. 1 shows a deployable L-Band antenna Quadrature matching circuit with Nintinol. FIG. 1 shows a preferred embodiment, schematic as a basis for the electrical circuit that is a necessary part of the antenna.

First, the quadrature matching network will be described. In this illustrated case, a commercially available quadrature power combiner is utilized. This structure sums the signal at the quadrature ports in a 0, 90, 180, and 270 degree phase difference method. Internal resistor terminations are included for the isolated ports of the internal hybrid networks. In another embodiment, there is a discrete lumped element network that can be used. An advantage of the lumped element network is that it can be designed to handle more Radio Frequency power when used in a transmitter mode. Another reason to use this network is for frequency ranges where a commercial quadrature coupler is not available. A limitation of the discrete lumped element network can be the higher frequency that can be desired. The discrete lumped element quadrature coupler has been demonstrated to be useful to 1000 Megahertz.

The Bilateral Quadrature Lumped Network with Filar Impedance Match and DC Bias Network will now be described.

Looking from the antenna connector, or source, a known lumped element balun is made from two phase shift networks. Two branches from the source, one branch a series capacitor followed by a shunt inductor form a plus 90 degree port, and a second branch with a series inductor followed by a shunt capacitor form a minus 90 degree port. The frequency range of this balun is sufficiently broad as to be useful for normal frequency ranges used by these antennas.

Each of these balun ports can be separately connected to known lumped element "hybrid" networks. The known hybrid network makes use of four lumped element quarter wave phase shift networks. The characteristic impedance of the phase shift networks is adjusted depending on the characteristic impedance of the phase shifted ports. The hybrid can be used either as a power combiner or a power splitter bilateral network.

The hybrid can have four ports, a common port, an absorptive reflection port, and two phase shifted ports; one minus 90 degree and one plus 90 degree port.

Four phase shifted ports are then available from the Bifilar Quadrature Lumped Element Network representing a relative 0, 90, 180, and 270 degree four cycle impedance transformation network.

These four ports are available to the impedance matching network of the individual filars.

A description of the network can be continued from the 0 degree port to the connection to filar port 1. A set of four transmission lines from each of the quadrature coupler is used such that each transmission line is of equal length. The transmission lines can be conveniently configured as microstrip or stripline transmission lines due to the short lengths involved.

The nature of the driving point impedance of an individual filar at the proximal base is such that a two component match can be utilized. A preferred configuration is for a series capacitor from the transmission line to the filar attachment point and a shunt inductor. The components should be configured with minimal lead length. The same circuit is utilized at the other three filar connection points.

The shunt inductors do not go directly to ground. Instead, an RF bypass capacitor is used between the inductor and ground. The net impedance of the circuit leg of the inductor and the RF bypass capacitor is very nearly the same. This then provides a means to satisfy the impedance characteristics of that leg of the circuit network.

A Direct Current is able to be applied from the Bias Plus terminal, through the two bifilar loops and returning to the Bias Minus terminal. A conducting path is routed on the printed circuit board to continue the series path to the Bias Minus terminal.

Recently, commercially available quadrature coupler components have become available and can be used with FIG. 1. The quadrature coupler allows four ports representing signals 0, 90, 180, or 270 degrees of phase to be combined. While the component is bilateral, the transmit power capability is on the order of approximately 1 watt, thus limiting the use in the transmit mode without further amplification which could be accomplished. The quadrature coupler contains internal 50 Ohm isolated terminations to absorb reflected signals.

The four quadrature related signals are fed by equal phase length transmission lines to filar impedance matching networks. The driving point impedance of each filar is dependent on the filar length, the structure diameter, and the pitch angle of the filar. As such, it can be possible to find convenient 50 Ohm driving point dimensions. However, normally, other factors cause the driving point impedance to be different than a pure 50 Ohm resistance. So, Cm1 and Lm form an impedance transformation network at each filar. Their function is to transform the driving point impedance of a filar to, in this case, 50 Ohms.

The coil, Lm, serves a second function to apply Direct Current to the bifilar loops for heating to the activation temperature of about 80 degrees Centigrade. The capacitors, Cm2, serve as RF bypass to allow the inductors, Lm, to be essentially connected to RF ground.

Voltage applied to the +V and −V terminals upon deployment for approximately a minute heat the DC series circuit made up of the two bifilar loops and the four retention loops.

Figure 2:
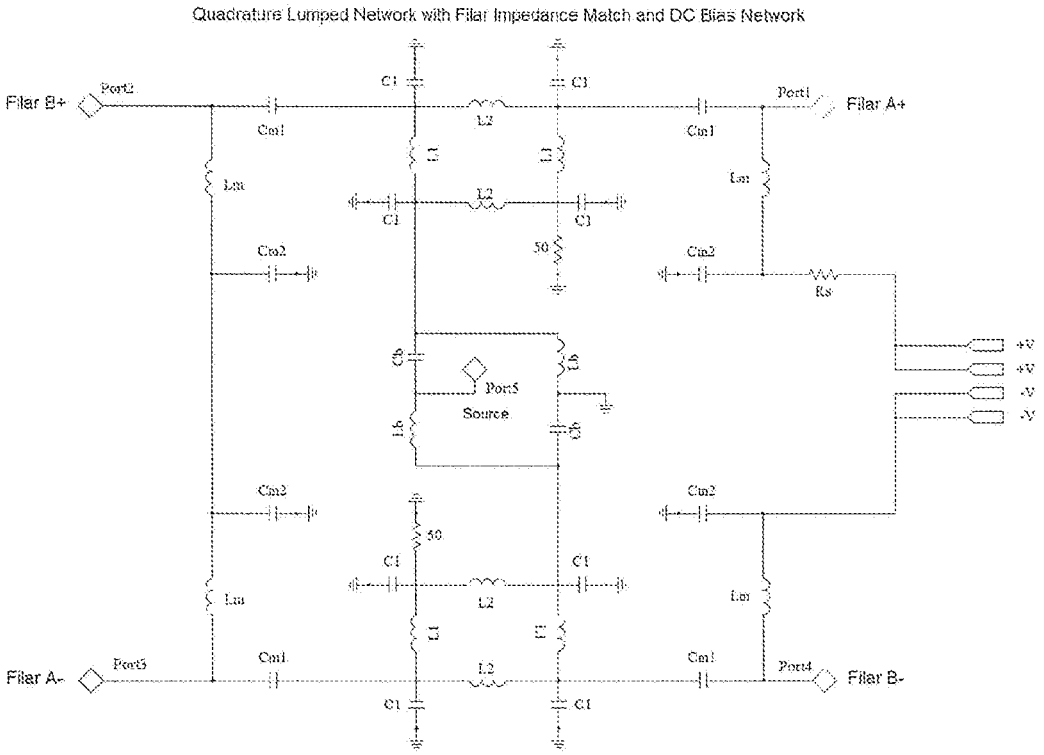
FIG. 2 shows another deployable L-Band antenna Quadrature matching circuit with Nintinol heating capability.

FIG. 2 shows another deployable L-Band antenna quadrature matching circuit with Nintinol heating capability. In a preferred embodiment, refer to the above schematic as a basis for the electrical circuit that is a necessary part of the antenna.

First, the quadrature matching network will be described. In this illustrated case, a commercially available quadrature power combiner is utilized. This structure sums the signal at the quadrature ports in a 0, 90, 180, and 270 degree phase difference method. Internal resistor terminations are included for the isolated ports of the internal hybrid networks. In another embodiment, there is a discrete lumped element network that can be used. An advantage of the lumped element network is that it can be designed to handle more Radio Frequency power when used in a transmitter mode. A limitation of the discrete lumped element network can be the higher frequency that can be desired. The discrete lumped element quadrature coupler has been demonstrated to be useful to 1000 Megahertz.

A description of the network can be continued from the 0 degree port to the connection to filar port 1. A set of four transmission lines from each of the quadrature coupler is used such that each transmission line is of equal length. The transmission lines can be conveniently configured as microstrip or stripline transmission lines due to the short lengths involved.

The nature of the driving point impedance of an individual filar at the proximal base is such that a two component impedance match can be utilized. The preferred configuration is for a series capacitor from the transmission line to the filar attachment point and a shunt inductor. The components should be configured with minimal lead length. The same circuit is utilized at the other three filar connection points.

The shunt inductors do not go directly to ground. Instead, an RF bypass capacitor is used between the inductor and ground. The net impedance of the circuit leg of the inductor and the RF bypass capacitor is very nearly the same. This then provides a means to satisfy the impedance characteristics of that leg of the circuit network.

A Direct Current is able to be applied from the Bias Plus terminal, through the two bifilar loops and returning to the Bias Minus terminal. A conducting path is routed on the printed circuit board to continue the series path to the Bias Minus terminal.

During our testing, it was found that the Nitinol bifilar loops rebounded approximately an inch above the desired stowed position. This was corrected by replacing the voltage dropping resistor with Nitinol "Retainer Loops" in quadrants around the stowed antenna to restrict the bifilar loops to their desired height.

The total resistance is favorable for the 8.4 VDC standard voltage bus to deliver the desired current to heat the Nitinol bifilar loops. The Nitinol Retainer Loops are made from 1 mm Nitinol wire. As such, the Retainer Loops heat and therefore activate quicker than the bifilar loops.

Referring to FIG. 2, At the center of the schematic is a bilateral port for either receiving or transmitting signals to or from the antenna. The center port has two branches. One branch started by series capacitor, Cb, and shunt inductor, Lb, form a plus 90 degree phase shift at the center frequency of the antenna. A second branch started by a series inductor, Lb, and a shunt capacitor, Cb, form a minus 90 degree phase shift at the center frequency of the antenna. This is a known technique to form a balun. The balanced balun outputs are then available to each of the bilateral lumped element known hybrid networks.

At the top center of the schematic is one of two known hybrid networks. Four capacitors, each labeled C1 and four inductor labeled L1 twice, and L2 twice make up a known bilateral lumped element hybrid network. The C1 capacitors contribute on half of their capacitance to one leg of the network and the other half in another joined leg of the network. Half of C1 in shunt, L2 in series, and another half of another C1 form a known low pass PI network at a characteristic impedance of the practical 50 Ohms divided by the square root of two. This portion of the hybrid can form an equivalent quarter wave transmission line transformer. Similarly, on the opposite side of the hybrid is another equivalent quarter wave transmission line transformer, again formed by half of C1 in shunt, L2 in series and a half of C1 in shunt. Two other equivalent transmission line transformers are made by using one half of C1 in shunt, L1 in series, and a one half of a C1 in shunt. A 50 Ohm resistor is connected to the isolated port of this hybrid network. The purpose of the 50 Ohm resistor is to absorb reflected power from the output ports.

The phased ports from the hybrid networks are offset by 90 degrees at the antenna center frequency. Thus, four characteristic impedance port are available as 0, 90, 180, 270 degrees relative offset from each other. The circuit can be easily arranged to be 0, −90, −189, −270 degrees to allow generation of either right hand or left hand circular polarity.

At each filar a series and shunt component are used to transform the filar driving point impedance to the characteristic impedance, normally 50 Ohms. This is a known technique to transform impedance. This circuit layout is configured to allow either a series capacitor or an inductor, together with a shunt capacitor or inductor to be placed on the printed wiring board. In most cases, the matching mathematics a series capacitor and a shunt capacitor are used because generally, capacitors are less expensive. In some cases, a shunt inductor is preferred because it seems to allow the filar length to become somewhat more stable in terms of the matched filar length.

The printed wiring board can be laid out such that either a capacitor or a coil can land on the same pads allowing interchangeability of the surface mount components.

The balun and the two hybrid networks as well as the filar match networks can be interconnected by nominal characteristic microstrip transmission lines. The transmission lines can also be conveniently formed as striplines. The lengths of the transmission lines are to be symmetrically equal in phase. The transmission lines to the filars can all be of the same length. The two transmission lines from the balun to the hybrids can all be of the same length. The purpose is to maintain the phase relationships to each of the filars.

A feature of the filar to printed wiring board is that zero insertion force or similar connectors are used from the board to the filar electrical connection. This has been found to be important in maintaining a good connection to the filars. It eliminates soldering to the filars which are sometimes wound on thin mylar material.

The series loop direct current (DC) heating circuit can be included to heat the filars to their activation temperature. This DC heating circuit is isolated from the radio frequency (RF) circuits by the dual function use of the Lm coils. The "Lm" coils serve as matching inductors for the signals and as RF chokes for the DC circuits. The "Cm2 capacitors are used as RF bypass elements. The CM2 capacitors are essentially AC or RF short circuits at the RF signal frequencies. The CM2 capacitors effectively are the return to ground functions for the Lm coils.

The two bifilar loops and the four retention loops are wired in direct current series. The filars and the retention loops are heated when voltage is applied at the V+ and V− terminals. The terminals are doubled up for reliability of the internal satellite wiring.

This means of allowing RF antenna performance while also providing a means to heat the filars upon deployment after rocket launch is an essential aspect of this invention.

This solves a NASA (National Aeronautics and Space Administration) problem for deployment without expending material into space, which eliminates any pieces of "cut wires" or explosives to be left in space.

Figure 3:
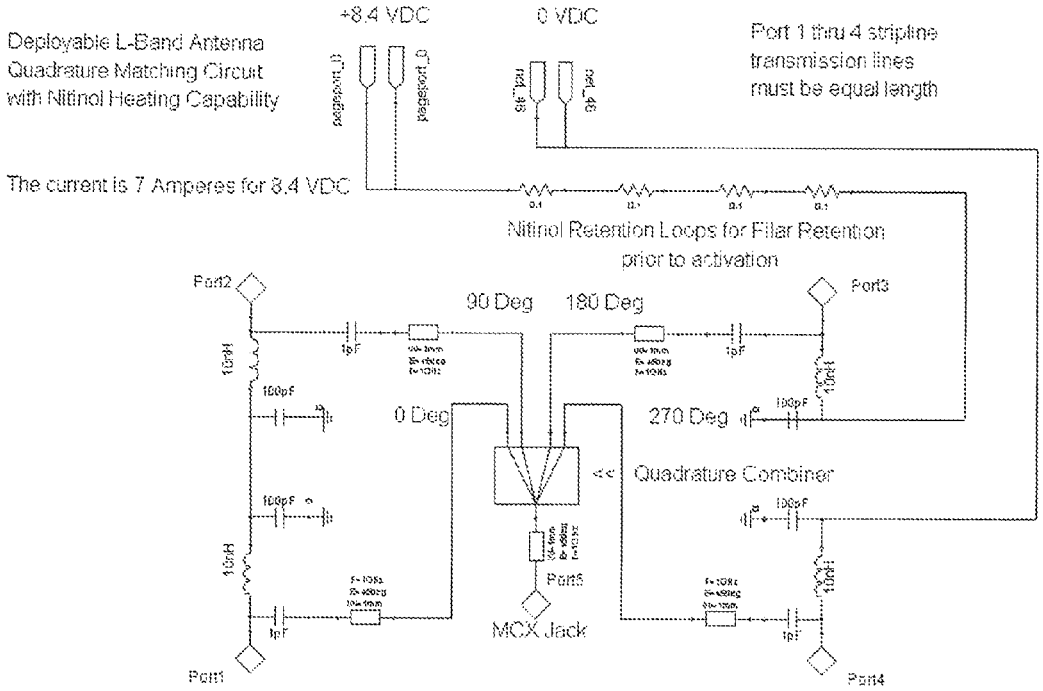
FIG. 3 shows a schematic of an alternate version of the deployable L-Band antenna Quadrature matching circuit with added retainer loops for filar retention. This circuit employs a quadrature lumped element circuit for applications above 1 GHz.

FIG. 3 shows a schematic of an alternate version of the deployable L-Band antenna Quadrature matching circuit prior to adding the retainer loops for filar retention. This circuit employs a quadrature lumped element circuit for applications below about 1000 where bilateral receive and transmit capability are desired. The transmit capability allows power up to at least approximately 100 watts.

The four resistors in the plus voltage lead represent the Nitinol wires. Each resistor represents the resistance of an individual retention loop. The Nitinol retention loops are heat treated to a stored memory shape. The shape for the retention loops is to be in the form of a "U" shape that allows the filars to be deployed.

A single series Direct Current circuit can be formed with the four Nitinol Retention Loops and the two bifilar loops. When the voltage is applied for approximately one minute this circuit heats the Nitinol wires to about 80 degrees Centigrade, thereby causing the Nitinol wires to resume their stored memory shape.

From experimentation, we learned the Nitinol filars had a tendency to spring out more than could be allowed. So we developed the retainer loops to retain the bifilar loops sufficiently for staying within the size envelope for the size of the small satellite structure.

Figure 4:
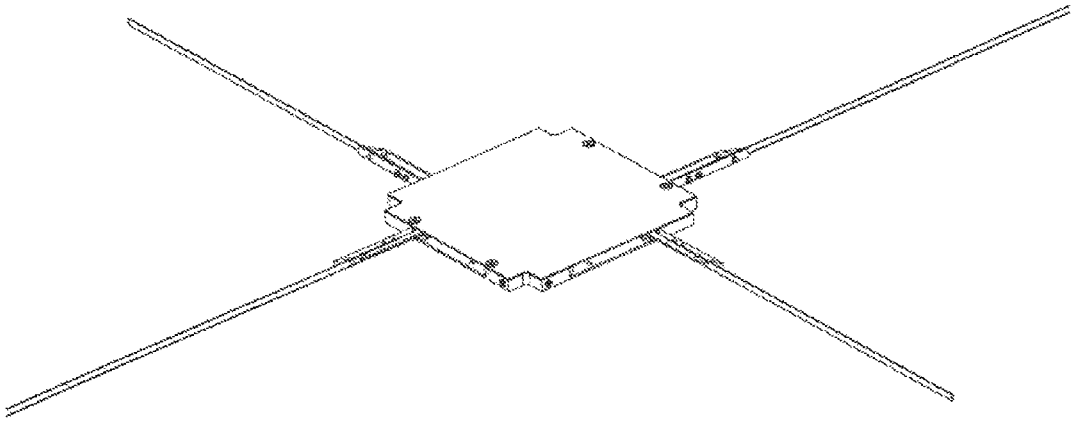
FIG. 4 (PRIOR ART)
FIG. 4 shows a perspective prior art view of a AO-73 Fun Cube Antennas.

FIG. 4 shows a perspective view of prior art AO-73 Fun Cube Antennas which was described in the background section of the application.

Figure 5:
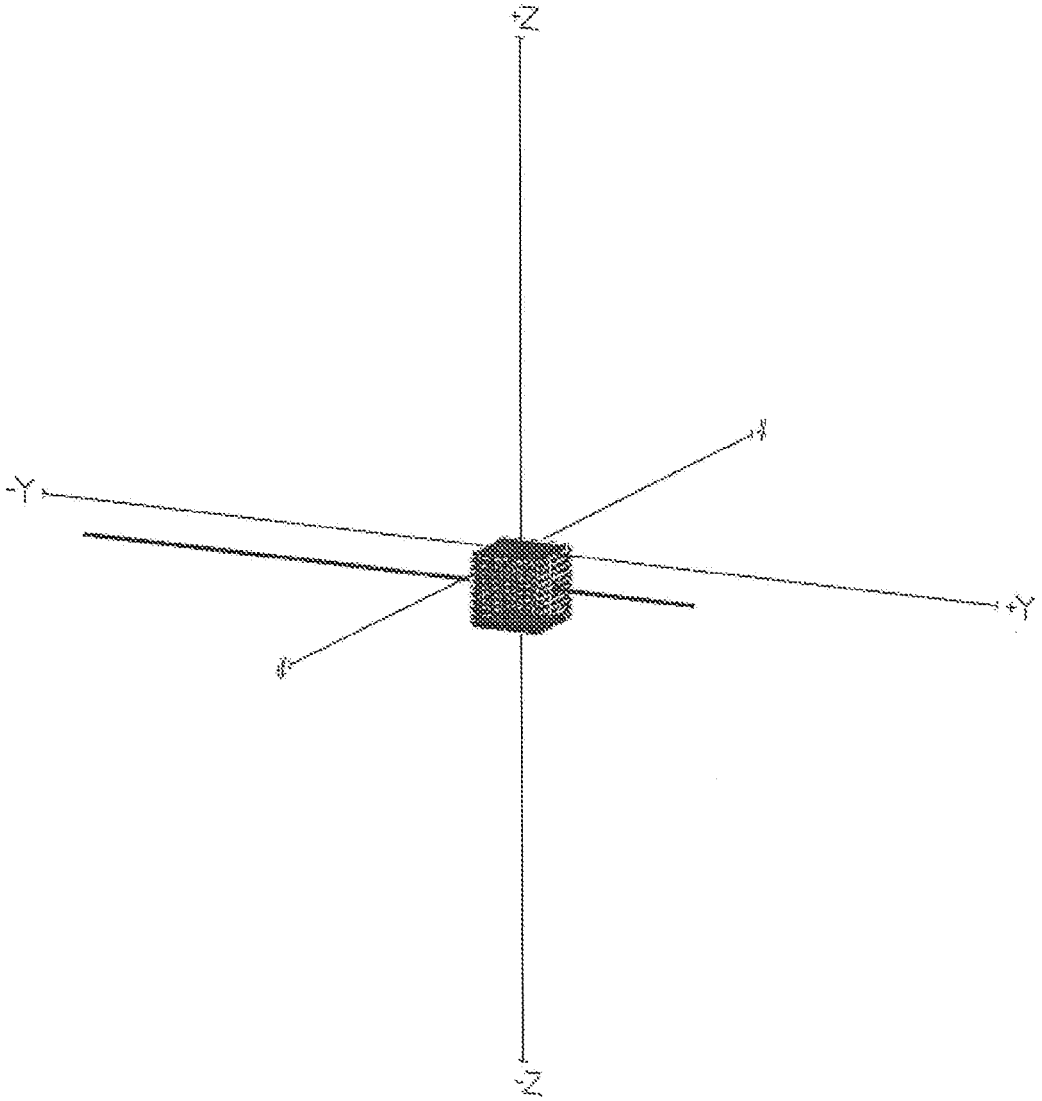
FIG. 5 (PRIOR ART)
FIG. 5 shows a prior art 436.5 MHZ Horizontal Monopole on the right, and a 145 MHz Monopole on left side of a 1U small satellite.

FIG. 5 shows a prior art view of a 436.5 MHZ Horizontal Monopole on the right, and a 145 MHz Monopole on left side of a 1U small satellite with a wide beam along the X orbit direction and narrow beam on both sides of the X path, which was described in the background section of the application.

Figure 6:
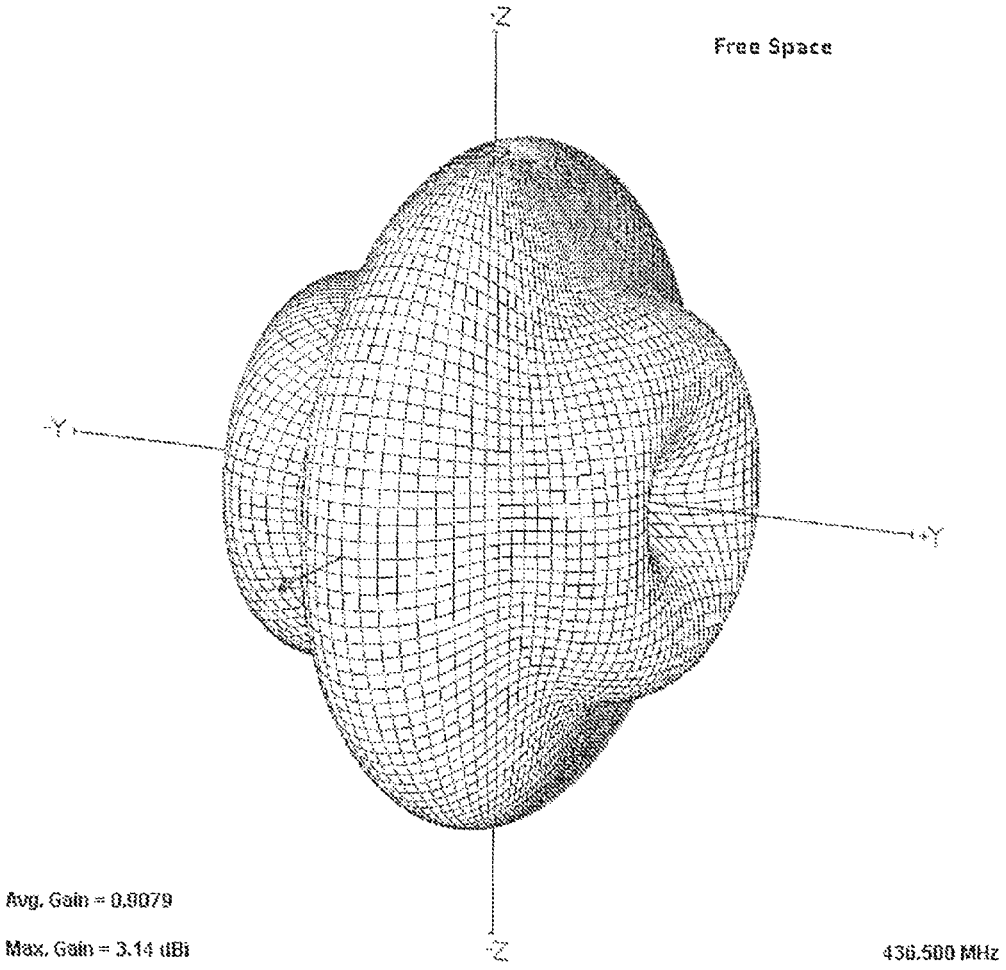
FIG. 6 (PRIOR ART)
FIG. 6 shows a prior art 436.5 MHz Horizontal Monopole on 1U small satellite with a wide beam along the X orbit direction and narrow beams on both sides of the X path.

FIG. 6 is a perspective view of a prior art antenna pattern from the 436.5 MHz monopole from FIG. 5 which was described in the background section of the application.

The following components are described below in reference to FIGS. 7-11.

Figure 7:
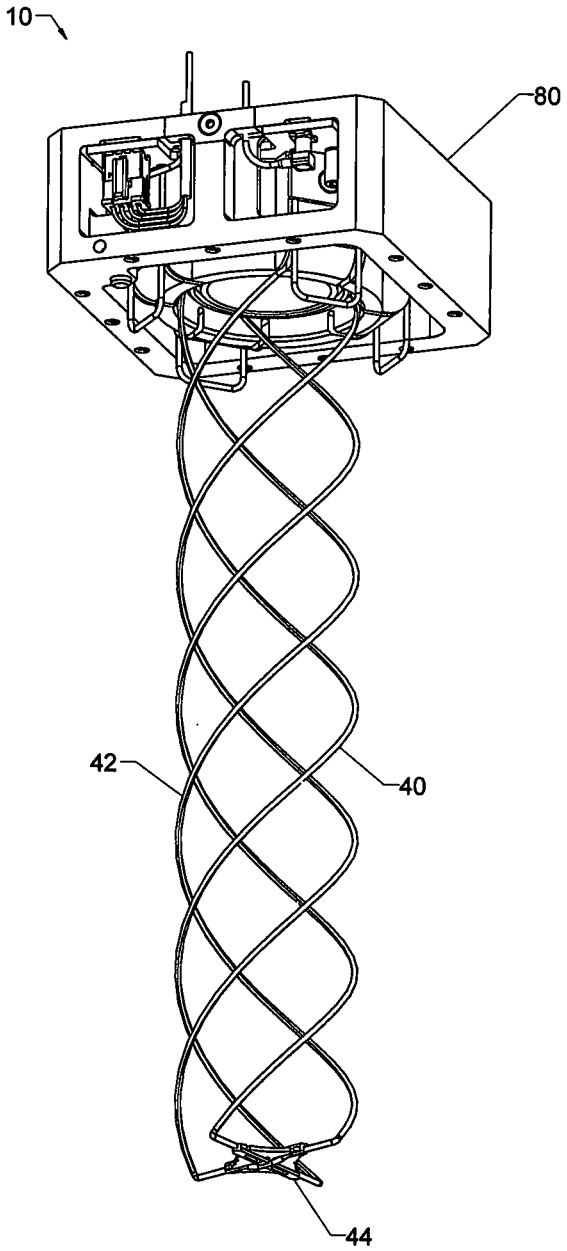
FIG. 7 is a perspective view of a Deployable L-Band Quadrifilar Helical Antenna in a deployed position.

10 stowable deployable L-Band QHA
22 heavy duty moisture-seal shrink tubing, to captivate fastener 24
24 fastener, such as shoulder screw with shoulder
30 Inner support
40 Filar B (Filar B has underpass at distal junction)
42 Crossover support
44 Filar A (Filar A has overpass at distal junction)
50 Hold loop support
52 outer support
54 Nitinol Hold loop with Insulating sleeve (Insulator over retention Nitinol wire)
56 Woven wire cloth, used as a gripping feature
58 Hold loop retainer and fastener (screw/bolt)
60 Quadrature Combiner (Component on underside of Printed Wiring Board)
62 Press Nut
64 Retention Receptacle for Hold Loop
66 Rotary joint receptacle
68 Press nut and standoff to retain Printed Wiring Board 70 and Flight cover 20
69 RF coaxial connector
70 HCT-QHA Printed wiring board contains traces for FIG. 3 Schematic
72 Connector for DC Power
80 Main housing, machined from ULTEM material
82 helical coil locking insert
84 Camera
86 screw set for camera
88 DC Power Cable assembly
90 cable holder
92 screw to retain cable holder
93 helical coil locking insert for screw 9294 RF Connector and Cable assembly
96 screw
97 screw
98 screw FIG. 7 shows a Deployed L-Band QHA 10 in a deployed and activated position from a Low Earth Orbit radiating toward Earth.

Figure 8:
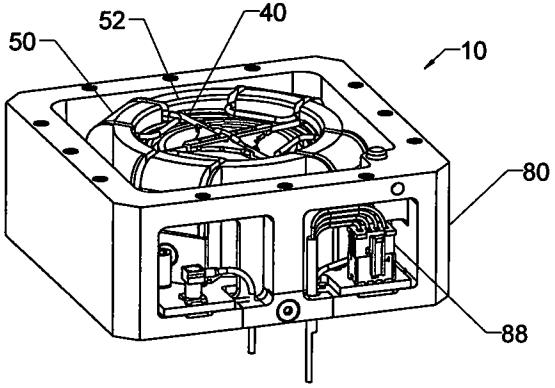
FIG. 8 shows the Deployable L-Band Quadrifilar Helical Antenna of FIG. 7 in a stowed position.
Figure 9:
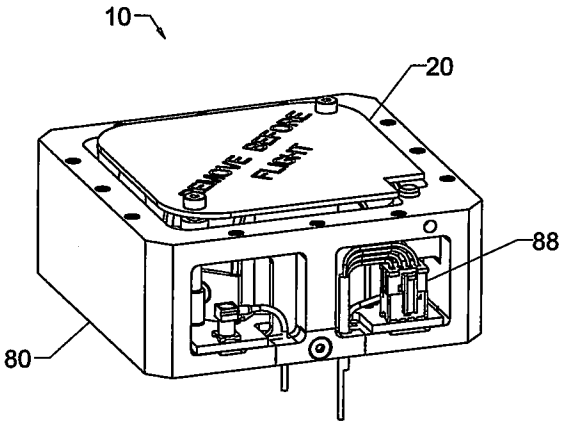
FIG. 9 is another view of the Deployable L-Band Quadrifilar Helical Antenna of FIG. 8 with a cover.

FIG. 8 shows the Deployable L-Band Quadrifilar Helical Antenna 10 of FIG. 7 in a stowed position. FIG. 9 is another view of the Deployable L-Band Quadrifilar Helical Antenna 10 of FIG. 8 with a cover 20.

Figure 10:
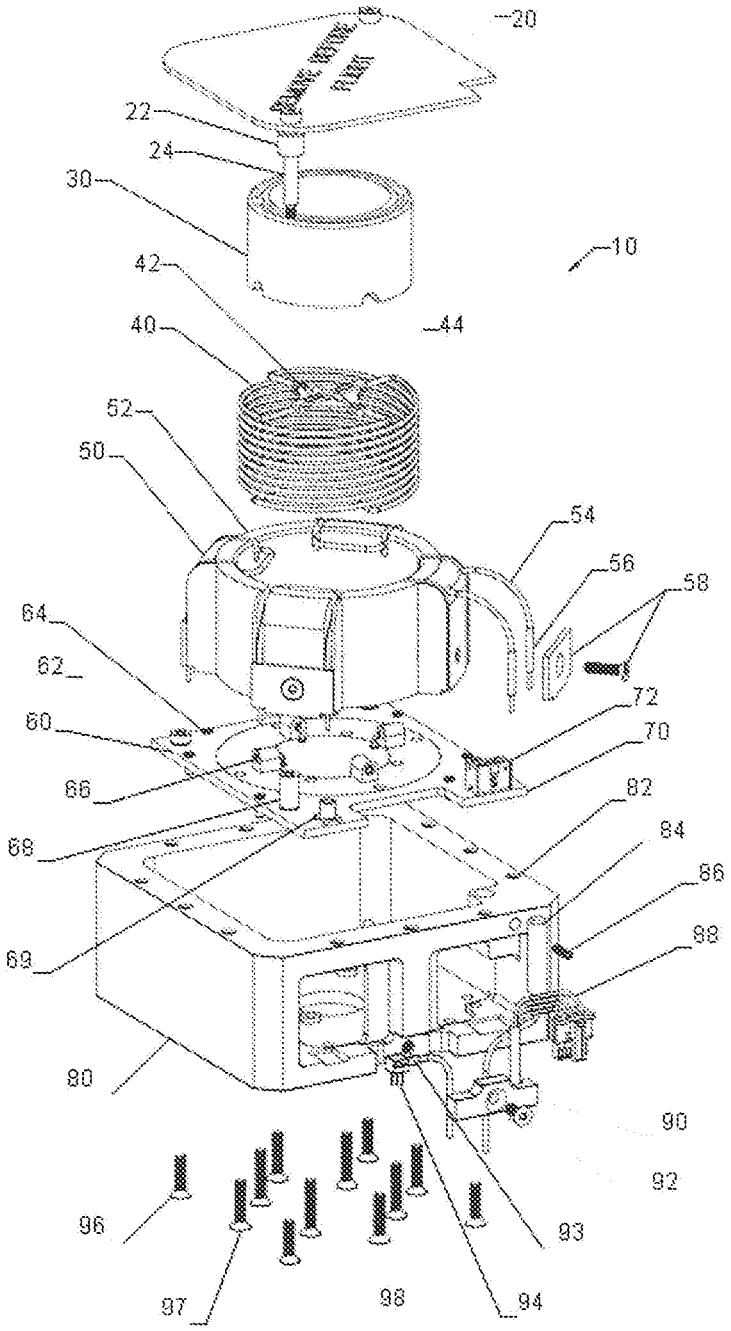
FIG. 10 shows an exploded view of the Deployable L-Band Quadrifilar Helical Antenna of FIGS. 7-9.

FIG. 10 shows an exploded view of the Deployable L-Band Quadrifilar Helical Antenna 10 of FIG. 8 in the stowed position.

Figure 11A:
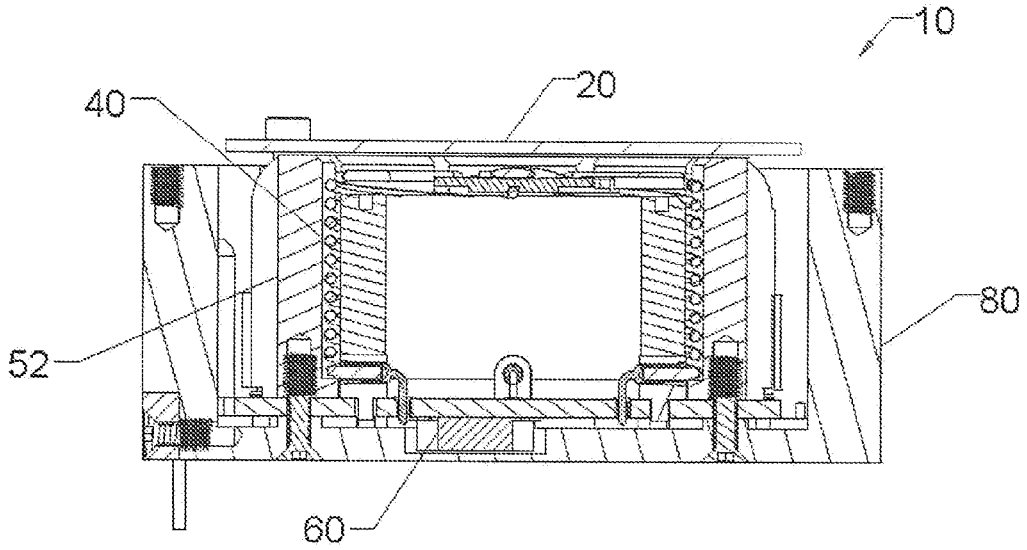
FIG. 11A shows a cross-sectional view in the stowed position of the deployable L-Band QHA of FIG. 9.

FIG. 11A is a cross-sectional side view of the Deployable L-Band Quadrifilar Helical Antenna of FIG. 10 in the stowed position.

Figure 11B:
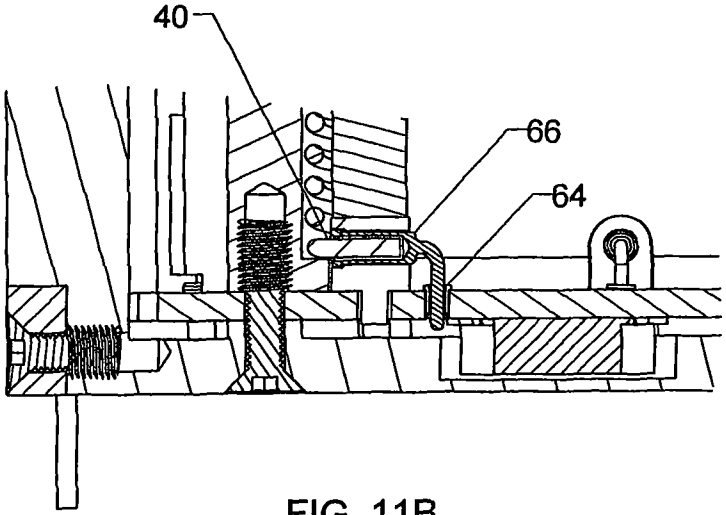
FIG. 11B shows an enlarged view of the filar rotary joint connection shown in FIG. 11A.

FIG. 11B is an enlarged view of the filar rotary joint shown in FIG. 11A. The stored memory shaped filar has an "L" bend at the proximal that is located into an available known rotary joint. During assembly, the filar is contained in the open area between the inner and outer support cylinders. This rotary joint allows the filar to rotate as the antenna is being deployed thereby evenly distributing the forces on the filar near the proximal.

Referring to FIGS. 7 to 11B, the complete Deployable L-Band QHA 10 can include main housing 80, made from ULTEM material, that contains hardware for the Deployable L-Band QHA. Fastener 22 and captivating sleeve 24 are used for the Remove Before Flight cover 20. Components 40 and 44, are the essential antenna radiating Nitinol wire forming two bifilar helical loops. There are two loops, named A and B. The difference between the loops is that at the distal junction, the A loop over passes the B loop so as not to be able to conduct DC power since the two loops are in DC series. Plastic crossover support 42 separates Bifilar Loop 40 from Bifilar Loop 44. The crossover support assures 42 that no DC connection will occur at this distal intersection of the two bifilar loops.

Nitinol wire Retention Loop 54 covers four of these loops wired in DC series with the two bifilar helical loops. These loops have an insulating sleeve to ensure DC isolation to the bifilar loops. Woven wire cloth 56 provides additional friction to hold the Retention Loops in place. Retention receptacle 64 can be used for the Retention Loops 54 and Retention Loop support 50. Component 58 provides a Retention Loop retainer and fastener.

Printed Wiring Board 70 holds the two bifilar loops via rotary connections 66. The Printed Wiring Board 70 includes the impedance matching coils and capaciotor, the quadrature coupler component 60, and the microstrip transmission lines and the wiring to maintain the DC heating circuit.

Inner support 30, and component 52, the outer support 52 form a confined space between them so that the bifilar loops, 40 and 44 can reside in a well-defined area while stowed. There are also detail provisions that allow easy release of the filars upon deployment.

RF coaxial connector 69 attaches to the printed wiring board 70. The RF coaxial connector 69 is used in a bilateral manner to receive or transmit signals to the antenna. The center pin of the RF coaxial connector is connected via a printed wiring board transmission line to the common port of the quadrature coupler.

RF Connector and coaxial cable assembly 94 feeds the signal to the satellite receiver or transmitter.

Fastener 92, such as a screw, and the like is used to retain the cable holder 90. Helical coil 93 is a locking insert for fastener 92.

DC power connector 72 can be used to connect the DC power to the series two bifilar loops and the four retention loops. Two terminals can be used for the plus voltage and two terminals are used for the minus terminal. Dual connections are used to provide a measure of redundancy for the inter-cabling of the satellite circuitry.

Press Nuts 62 can be used for retention of the rotary receptacle 66. Press Nuts 68 and standoff can be used to retain the Printed Wiring Board 70 and the Remove Before Flight cover 20.

Fasteners (such as but not limited to screws, and the like) 96, 97, and 98 attach the inner support 30, outer support 52, and the Printed Wiring Board 70 to the main housing 80.

Helical coil locking inserts 82 can be used for retention of other components, such as a camera 84. The camera 84 can be used to observe the position of the deployed antenna to assist in verifying the antenna is properly deployed. Fastener 86, such as but not limited to a set screw, and the like, can be used for holding the camera 84 in place.

Figure 12:
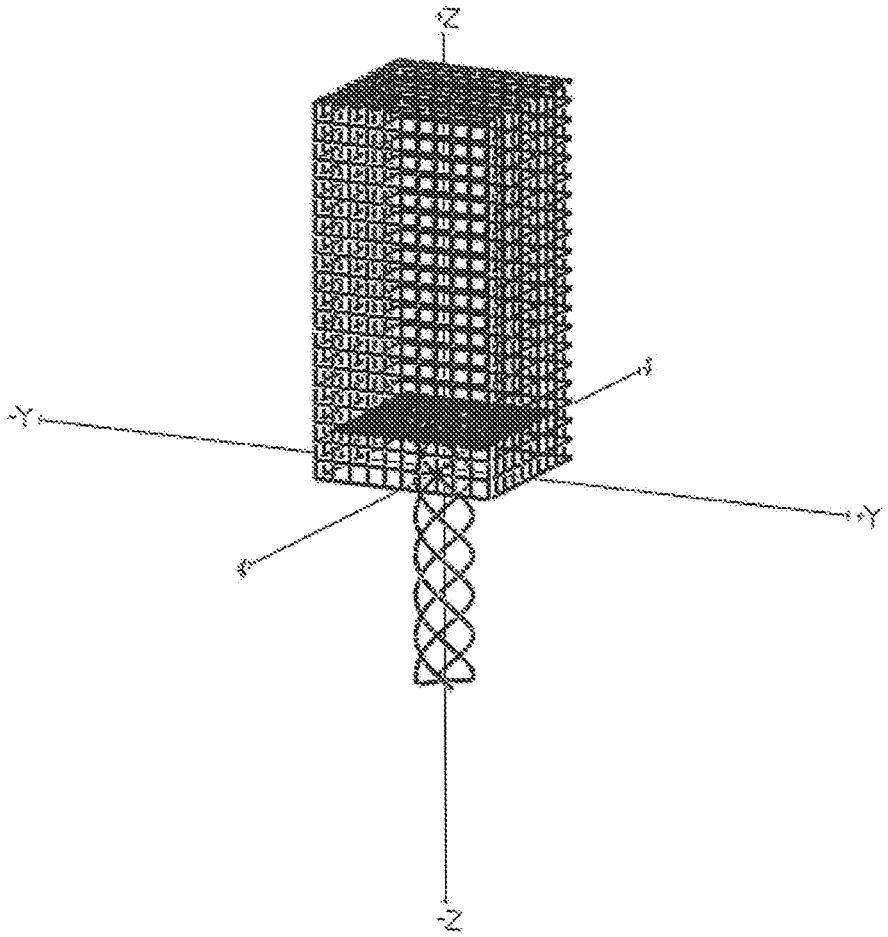
FIG. 12 shows a simulated structure of a 2.3 GHz Iso-Flux QHA as deployed on a 2U Cube Sat.

FIG. 12 shows a simulated structure of a Deployable Iso-Flux 2.3 GHz QHA. The rectangular gridded structure simulates the outer metal housing of a 2U Cube Satellite. The antenna pattern for the FIG. 12 structure is shown in FIG. 13.

Figure 13:
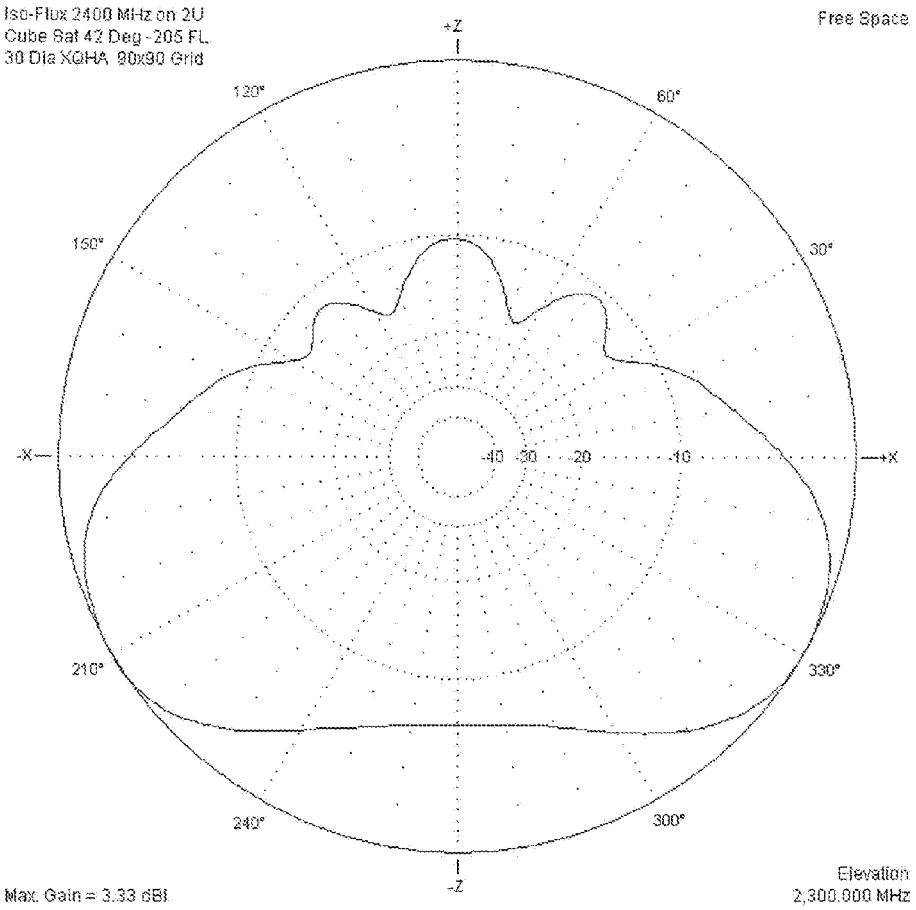
FIG. 13 shows the resulting simulated Iso-Flux antenna pattern generated by the FIG. 12 QHA structure as deployed on a 2U size Cube Sat.

FIG. 13 shows a desirable Iso-Flux elevation pattern from the structure of FIG. 12. The Iso-Flux pattern provides near equal signal levels from the longer slant range to the shorter nadir range. The Nadir pattern is down 6 dB. The Iso-Flux pattern provides equal signal levels from slant range to nadir. FIG. 13 is a simulated Iso-Flux antenna pattern using the 2U with antenna structure of FIG. 12.

Figure 14:
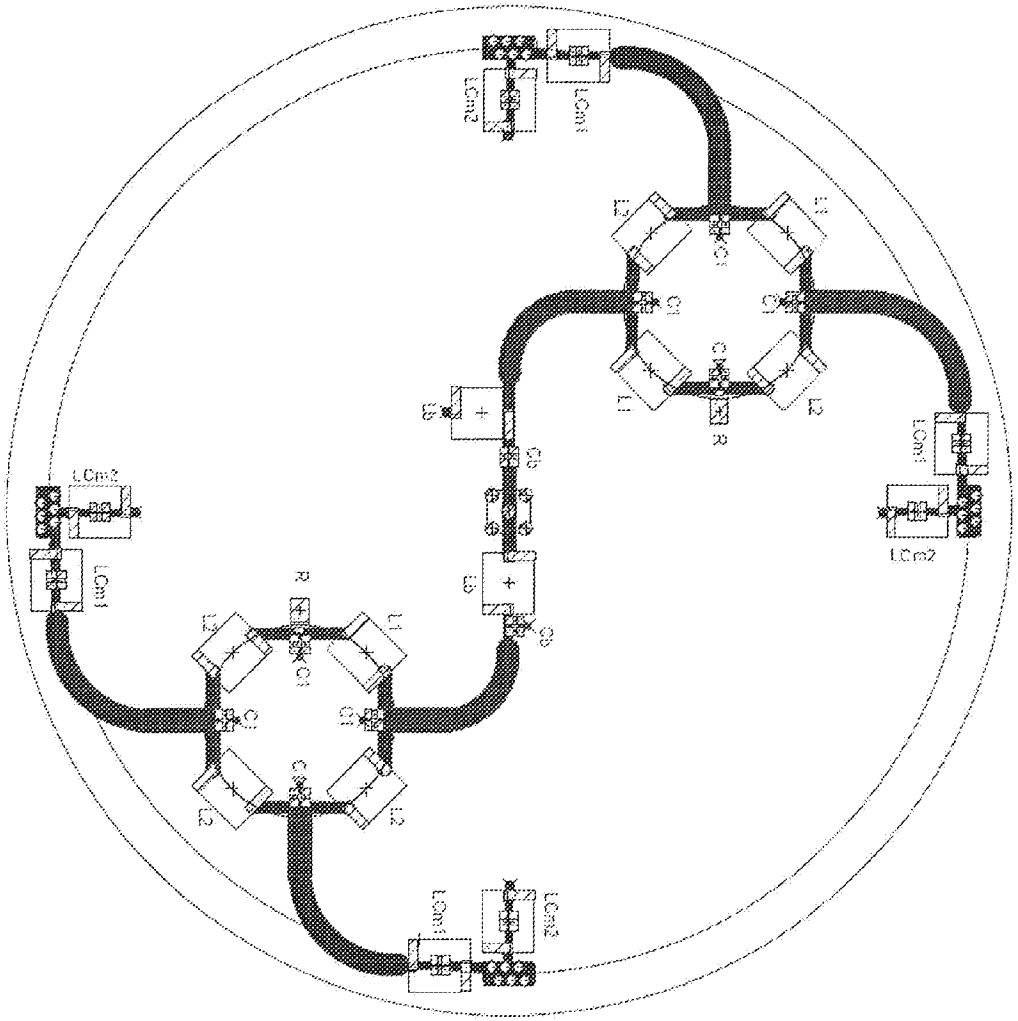
FIG. 14 is a view of the Bilateral Quadrature Lumped Element Network showing the component layout and the transmission lines between circuit functions.

FIG. 14 is a view of the Bilateral Quadrature Lumped Element Network showing the component layout and the transmission lines between circuit functions. FIG. 14 shows the relative layout of components on the bilateral quadrature lumped element matching circuit. The lumped element balun is at the center. The two lumped element hybrid couplers are at the upper left and lower right in the view. Each of the circuit functions are interconnected with equal length microstrip transmission lines. This shows the lumped element balun at the center, two lumped element hybrid couplers and lumped element matching components at the filar ports. Each of the circuit functions are interconnected with equal length stripline or microstrip transmission lines.

For this present invention the printed wiring board is set to accommodate, from the filar proximal, a shunt coil to common RF ground and from the filar proximal, a series capacitor to a transmission line interconnect to a hybrid coupler. The printed wiring board is set to accommodate either a surface mount capacitor or surface mount inductor at either of the locations. Similar circuitry exists at each of the four filar proximal connections to the printed wiring board. The coils and capacitors along with the transmission lines are able to transfer reasonably higher power from a transmitting source to the quadrifilar helical antenna.

The layout of the printed wiring board is conducive to good RF performance with minimal signal coupling between filars.

This deployable quadrature helical antenna is designed to be stowed within small satellites, as small as a one unit or 1U size. Upon dispensing from the launching rocket, the antenna is allowed to deploy by injecting direct current power into the Nitinol antenna filars to resume their memory stored shape. A significant aspect of the quadrature helical antenna for this invention is the Iso-Flux radiation pattern that is achieved by arranging the diameter, axial height, and pitch angle of the filars. The antenna filars are arranged as bifilar loops.

The antenna filars are impedance matched to 50 Ohms and then the quadrature phase related signal is combined to deliver signals to a 50 Ohm port for connection to a receiver. The invention works equally well as a bilateral receive or transmit function. The antenna has solved concerns relative to angular changes of the filar at the proximal so the filars can deploy to their desired memory stored shape, thereby relieving any tension at the proximal terminals of the filars. The antenna has solved deployment issues related to the characteristics of the Nitinol wire.

An isoflux antenna pattern favoring best gain at high offset from nadir angles so as to provide high gain at the longer slant range. The isoflux pattern is characterized by an antenna pattern shaped to provide higher gain at higher satellite slant with respect to the ground station. This isoflux pattern has been attained by configuring the antenna dimensions easily within a typical 1U cube sat housing. These antenna dimensions have been found by computer simulation to be the minimum axial height along with the desirable pitch angle allowed by the diameter for the 1U cube sat structure as selected at the operating frequency.

The two bifilar loops can be retained at the proximal by rotatable right angle joints. These rotary joints significantly aid in stowing the antenna by allowing a stress relief on the Nitinol wire. This same means of a rotary joint is possible at the filar distal, but was not considered necessary for this antenna.

The two bifilar loops can be retained without the use of solder to position the loops.

The two bifilar loops can be retained in the right angle rotary joints by an outer insulating cylinder material. The assembly procedure is to install the bifilar loops into the rotary joints followed by assembly of the outer cylinder to retain the filars into their intended position. The filars are thusly confined in their intended location.

The antenna can include a means at the distal to firmly set the quadrature relation of one set of bifilar loop with respect to the other and also retain the symmetry of the quadrature placed filars. This means includes definitive grooves that guide the filars to their respective positions.

The direct current can be arranged to wire the bifilar loops and the retainer loops in direct current series. Further, the retainer loops utilize 1 mm diameter Nitinol wire, in this case, while the bifilar loops utilize 1.5 mm diameter Nitinol wire. In this manner, the retainer loops activate prior to the bifilar loops thus allowing the antenna structure to deploy upon activation of the direct current. The voltage to achieve this is near the 8 to 9 volts supplied by the conventional power bus utilized in the small satellite community.

A printed circuit board can become the juncture for the impedance matching components, the direct current isolation inductor and the appropriate bypass capacitor, the stripline transmission lines and the radio frequency connector as well as a direct current connector for activating the deployable structure. The stripline transmission lines are arranged to have nearly the same electrical phase length in order to provide a 0, 90, 180, 270 degree phase relation each filar of the two bifilar loops. The printed circuit board thickness has been chosen to sustain necessary characteristic associated with vibration, shock, and hazards associated with launching satellites into orbit.

The antenna can utilize memory shaped Nitinol wires. These wires are placed on a stainless steel mandrel machined so that the wire as placed on the mandrel assumes the memory stored shape.

The present invention is a deployable Quadrifilar Helical Antenna made up of two bifilar loops that deploy to their memory shaped positions after the Nitinol filar wires are heated to their activation temperature. The heating is scheduled to occur after the small satellite is launched from its rocket dispenser.

The bifilar loops are connected to a printed circuit board that accomplishes several functions. The antenna filars, as individual wires, need to be impedance matched to a 50 Ohm impedance in the frequency band of interest. This is accomplished by a shunt inductor, a bypass capacitor, and a series capacitor. The shunt inductor serves two purposes. The first purpose of the shunt inductor is as one of two impedance matching components to transform the filar driving point impedance to 50 Ohms. The second purpose of the shunt inductor is to serve as a means to connect the direct current for heating the bifilar loops to the activation temperature of the Nitinol wire. The bypass capacitor allows the ground side of the shunt inductor to be equivalent to Radio Frequency ground. The series capacitor has two functions also. The first function of the series capacitor is to be part of the impedance match from the proximal filar to the quadrature combining network. The second function of the series capacitor is to isolate the direct current of the heating circuits from the quadrature combining network. There are four of these networks, one each for the four filars.

The 50 Ohm side of the series capacitors, opposite the filar terminal, are each connected to a stripline transmission line to the terminal of the quadrature combiner. A stripline transmission line, with 50 Ohm characteristic impedance is chosen over microstrip or coplanar transmission lines in order to minimize stray RF fields around the transmission line. It is important for the electrical length of each of the four striplines be equal in order to maintain the quadrature phase angle relationship.

The four stripline transmission lines are connected to a quadrature combining component for convenience. In another variant of the invention, a discrete lumped element network circuit can be used. In a preferred embodiment, the network is comprised of a balun and two 90 degree hybrid couplers. The couplers include a 50 Ohm terminating resistor for the isolated port of the 90 degree hybrid couplers. A schematic of a discrete lumped element quadrature combiner will be included. The network is bilateral allowing it to be useful in both receive and transmit modes. An advantage of the discrete network is that it can be designed to handle more RF power than available commercial quadrature combiners and in the frequencies where the size of the commercial parts would become too large.

The DC heating circuit of the Nitinol bifilars, in the present invention, has been arranged in a novel series configuration. The printed circuit board is equipped with a four pin connector. Two pins are for the positive voltage. The other two pins are for the negative return voltage. In the small satellite space environment, the use of redundant voltage supply wires can offer more reliability than single wires. Also, the dual wires provide for double the current a single wire could safely supply.

The DC power from the connector on the printed circuit board is conveniently routed on the top side of the printed circuit board on traces wide enough to carry the DC current with very little Ohmic loss. The sequential routing is as follows:

From the positive connector connection conveniently to the RF ground side of the Port 3 inductor, through the inductor to the Port 3 proximal filar.

Then from the Port 3 proximal filar, through the bifilar (labeled A) to the RF match side of the shunt inductor at Port 1, the DC continues through the inductor to a top side board trace.

The PCB trace continues the DC to the shunt inductor at Port 2. Then continuing as describe for Port 3, the DC passes thru the bifilar (labeled B) to the shunt inductor at Port 4. The RF ground side of the shunt inductor is then routed on the top side of the printed circuit board returning to the negative connector connection.

There is an RF Connector, an MCX receptacle type, connecting to the combined port from the quadrature combiner through a stripline transmission line. Any suitable RF Connector can be used.

There are novel mechanical features that make the deployment of the antenna without undue stress on the bifilars. There is a right angle insert that serves as a means to connect the filars to the printed circuit board. The proximal ends of the filars are inserted into the right angle devices. These devices allow the filars to rotate as the angle changes from the stowed angle to the deployed angle.

The filars in the stowed position are confined uniquely between an inner cylindrical holder and an outer cylindrical holder in a manner that upon deployment actions allow the filars to increase the pitch angle to the desired deployed angle. The assembly sequence provides for the ability to secure the inner cylinder, then attach the filars, and followed by the assembly of the outer cylinder which further captures the bend of the filars at the proximal. The outside of the inner cylinder and the inside of the outer The present invention is made up of the following components:

A. Bifilar A, with proximal endpoint legs, A 1 and A2.
B. Bifilar B, with proximal endpoint legs, B1 and B2.
C. 4 Bypass capacitors for providing RF ground to one side of the shunt inductors.
D. 4 Inductors for impedance matching and carrying DC.
E. 4 Capacitors for impedance matching and isolating DC from RF circuitry.
F. Stripline transmission lines, one for each filar and one for the source connection to the RF connector.
G. One quadrature combiner complete with internal isolated port termiations.
H. One 4 pin connector for the direct current power
I. One RF printed circuit board connector for the combined signal to be connected to the radio port.
J. One voltage dropping resistor near the positive voltage connector to adjust the voltage if necessary.
K. 4 right angle rotating joint connectors, one per filar
L. 4 inserts to secure the rotating joint without the need to solder the right angle rotating joint.
M. Printed Circuit Board.
N. One inner cylindrical holder.
O. One outer cylindrical holder.
P. One antenna chassis, made to fit within one standard 1U cube satellite chassis.
Q. 12 screws to secure the antenna printed circuit board and cylindrical holders.

The assembly of the invention begins with the bifilar loops, A and B. These bifilar loops for the present invention are meant to receive radiation from earth based signals near the ground. The nature of this antenna is that it is bilateral, that is it can be used to either receive or transmit radio frequency signals in the frequency band for which it is designed. These two bifilar loops are arranged in quadrature to be able to efficiently combine the energy in the signals transmitted from earth toward the combined RF connector on the Printed Circuit Board, M.

Each leg of the bifilar loop is first plugged into the 4 right angle rotary joint connectors, K. The K, rotary joints are pressure fitted into the printed circuit board, M. These joints firmly secure the bifilar loops to their direction from the printed circuit board, M. The bifilar loops, A and B, are further captivated by the inner cylindrical holder, N, and the outer cylindrical holder, O. These holders allow rotary action of the bifilars upon deployment after launch from the dispenser on the rocket.

With the bifilar loops firmly secured onto the printed circuit board the signals received on the filars are passed through impedance matching components. There are direct current heating functions used only during deployment. The impedance matching components are, E, the series capacitors, and D, the shunt inductors. The shunt inductors, D, are RF bypassed to RF ground through, C, bypass capacitors. This arrangement of components is a feature of this invention to combine RF performance with a DC heating method used during deployment. The method of choosing a shunt inductance is an important technique to provide means to perform the dual functions of impedance matching and means to supply DC to the bifilar loops, A and B.

The structure of the filars is critical to achieving the desired Iso-Flux antenna radiation pattern. The present invention secures the launch from the proximal right angle rotary joint together with the control of the bend of the filar to provide the necessary pitch angle for the Quadrifilar Helical Antenna. The control of the bifilar loops is achieved through the temperature heating profile of the Nitinol wire as confined by a specially designed mandrel that forces the Nitinol wire into the required shape for the Quadrifilar Helical Antenna.

The size of the deployable antenna can be increased for lower operating frequencies depending on the size of the small satellite. The diameter can be scaled for a smaller or larger diameter. The axial height can be scaled to be longer or shorter to achieve the desired radiation pattern.

The invention described herein is for an Iso-Flux antenna pattern. Other patterns can be achieved, such as maximum gain along the axis of the antenna. There is a wide range of beam widths that can be accommodated by adjusting the pitch angle, the diameter, and the axial height. Generally, lower pitch angles provide higher gain, narrower beam widths. The desired antenna radiation pattern can vary depending on the objective for the small satellite.

The invention can be used for antenna structures other than the Quadrifilar Helical Antenna. For instance, it can be appropriate to form the antenna as a Helical Antenna structure. It can also be configured to become a Four-Square Linearly polarized antenna.

While the present invention is focused on deployable Quadrifilar Helical Antennas for small satellite applications, the antenna structure is very appropriate for ground station antennas to receive signals from satellites. For the ground station antenna, an Iso-Flux antenna radiation pattern is very desirable in order to extend the useful range of the satellite to ground stations. For this purpose, the means to deploy the antenna using the wire heating method is unnecessary. For the ground station, larger antenna structures can be contemplated.

There can be other satellites where the deployable feature cannot be required. In those cases, we can remove the DC heating components and prepare an antenna structure to be capable of mounting on a satellite that can have the antenna in-situ, perhaps covered in a shield that would drop away sometime after launch.

An optional mid-structure support can be added to help stabilize and maintain the quadrature relation of the filars throughout the axial height.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as can be suggested by the teachings herein are particularly reserved especially as they fall within the breadth and scope of the claims here appended.

We claim:

1. A deployable quadrifilar helical antenna system for small satellites comprising:

a quadrifilar helical antenna having a stowed position and a deployed erected position, the quadrifilar helical antenna comprising memory shaped Nitinol wires formed in bifilar loops; and a direct current source for supplying direct current, wherein solely applying the direct current heats the memory shaped Nitinol wires formed in the bifilar loops to a selected temperature which causes the quadrifilar helical antenna to deploy from the stowed position to the deployed erected position, the memory shaped Nitinol wires include Nitinol retention loops heat treated to a stored memory shape, wherein the direct current is also used for heating the Nitinol retention loops.

2. The antenna system as in claim 1, wherein the quadrifilar helical antenna includes:

two bifilar loops, wherein an isoflux pattern is optimized by adjusting filar length, pitch angle, and diameter for a selected beamwidth, including an isoflux pattern.

3. The antenna system as in claim 1, wherein the quadrifilar helical antenna includes:

two bifilar loops impedance matched from a filar driving point impedance to approximately 50 Ohms, and are independently configured to allow the direct current source to activate the two bifilar loops to memory shaped stored positions.

4. The antenna system as in claim 1, further comprising:

additional memory stored loops to retain the stowed position, which are activated by the direct current source used by the antenna system.

5. The antenna system as in claim 1, further comprising:

an isoflux antenna pattern favoring best gain at high offset from nadir angles to provide high gain at the longer slant range.

6. The antenna system as in claim 1, further comprising:

two bifilar loops retained at a proximal end by rotatable right angle joints, which aid in stowing the antenna by allowing a stress relief on the Nitinol wires.

7. The antenna system as in claim 1, further comprising: a rotary joint for allowing filar from the bifilar loops to rotate as the antenna system is being deployed from a housing.

8. The antenna system as in claim 1, further comprising: two bifilar loops are retained without the use of solder to position the loops.

9. The antenna system as in claim 1, further comprising: two bifilar loops are retained in right angle rotary joints by an outer insulating cylinder material.

10. The antenna system as in claim 1, further comprising: means at a distal end to firmly set quadrature relation of one set of bifilar loop with respect to another bifilar loop and to retain symmetry of quadrature placed filars.

11. The antenna system as in claim 1, wherein the direct current is arranged to wire bifilar loops and retainer loops in direct current series.

12. The antenna system as in claim 1, further comprising: a printed circuit board which becomes the juncture for impedance matching components, a direct current isolation inductor and a bypass capacitor, stripline transmission lines and a radio frequency connector and a direct current connector for activating the antenna.

13. The antenna system as in claim 1, wherein the antenna system is used for an earth originated satellite.

14. The antenna system as in claim 1, wherein the selected temperature is about 80 degrees Centrigrade.

15. The antenna system as in claim 14, wherein the direct current is applied for approximately 1 minute.

16. The antenna system of claim 1, wherein the Nitinol retention loops are formed in a U shape.

17. The antenna system of claim 1, wherein the bifilar loops include two bifilar loops and the retention loops include four retention loops.

18. The antenna system of claim 1, wherein each of the bifilar loops include 1.5 mm diameter Nitinol wire, and each of the retention loops include 1 mm diameter Nitinol wire.

* * * * *